US010980383B2

(12) United States Patent
Zhu et al.

(10) Patent No.: US 10,980,383 B2
(45) Date of Patent: Apr. 20, 2021

(54) WATER-ABSORBING CYCLONE DUST CUP FOR SECONDARY DUST-AIR SEPARATION AND VACUUM CLEANER THEREOF

(71) Applicant: CUORI ELECTRICAL APPLIANCES (GROUP) CO., LTD, Cixi (CN)

(72) Inventors: Albert Zhu, Shanghai (CN); Lydo Ge, Shanghai (CN); Vivien Wang, Shanghai (CN); Frank Xi, Shanghai (CN)

(73) Assignee: CUORI ELECTRICAL APPLIANCES (GROUP) CO., LTD, Cixi (CN)

( * ) Notice: Subject to any disclaimer, the term of this patent is extended or adjusted under 35 U.S.C. 154(b) by 23 days.

(21) Appl. No.: 16/538,863

(22) Filed: Aug. 13, 2019

(65) Prior Publication Data

US 2019/0357745 A1 Nov. 28, 2019

Related U.S. Application Data

(63) Continuation of application No. PCT/CN2018/071502, filed on Jan. 5, 2018.

(30) Foreign Application Priority Data

Oct. 31, 2017 (CN) ..... 201711049623.8

(51) Int. Cl.
*B01D 50/00* (2006.01)
*A47L 9/16* (2006.01)
(Continued)

(52) U.S. Cl.
CPC ..... *A47L 9/1683* (2013.01); *A47L 9/165* (2013.01); *A47L 9/1608* (2013.01);
(Continued)

(58) Field of Classification Search
CPC ..... A47L 9/1683; A47L 9/1608; A47L 9/165; A47L 9/1658; A47L 9/18; A47L 9/02;
(Continued)

(56) References Cited

U.S. PATENT DOCUMENTS 3,618,299 A * 11/1971 Vincent ..... B01D 47/06 96/304
2009/0282791 A1* 11/2009 Lang ..... B04C 5/26 55/326
(Continued)

FOREIGN PATENT DOCUMENTS

CN 2394565 Y 9/2000
CN 2600043 Y 1/2004
(Continued)

OTHER PUBLICATIONS

Internation Search Report of PCT/CN2018/071502, dated Jul. 25, 2018.

*Primary Examiner* — Dung H Bui
(74) *Attorney, Agent, or Firm* — True Shepherd LLC; Andrew C. Cheng

(57) ABSTRACT

A water-absorbing cyclone dust cup for secondary dust-air separation comprises a dust cup cover body and a dust cup main body. The dust cup main body comprises a cup body portion, a primary cyclone arranged in an opening of the dust cup main body, and a secondary cyclone comprising a secondary cyclone main body provided with a ventilation hole defined in a center. At least one air guiding portion is arranged on a bottom end surface of the secondary cyclone main body. The air guiding portions comprise spiral air guiding plates, spiral air guiding passages formed by the spiral air guiding plates around the ventilation hole, and air guiding passage baffles enclosing first ends of the spiral air guiding plates, the spiral air guiding passages are formed by
(Continued)

spiral longitudinal extension along the center line direction of the ventilation hole.

9 Claims, 13 Drawing Sheets

(51) Int. Cl.
*A47L 9/18* (2006.01)
*A47L 9/02* (2006.01)
*A47L 9/04* (2006.01)
*A47L 7/00* (2006.01)

(52) U.S. Cl.
CPC ..... *A47L 9/1658* (2013.01); *A47L 9/18* (2013.01); *A47L 7/0004* (2013.01); *A47L 9/02* (2013.01); *A47L 9/0416* (2013.01); *A47L 9/0477* (2013.01); *A47L 9/1666* (2013.01)

(58) Field of Classification Search
CPC .... A47L 9/1666; A47L 7/0004; A47L 9/0416; A47L 9/0477
See application file for complete search history.

(56) References Cited

U.S. PATENT DOCUMENTS

2011/0296648 A1* 12/2011 Kah, Jr. ..... B04C 5/04 15/353
2012/0311814 A1* 12/2012 Kah, Jr. ..... F22B 1/284 15/347
2015/0026919 A1* 1/2015 Maeda ..... A47L 9/1683 15/353
2017/0361338 A1 12/2017 Ni
2018/0296047 A1* 10/2018 Ni ..... A47L 9/1633

FOREIGN PATENT DOCUMENTS

| | | | |
|---|---|---|---|
| CN | 101386010 | A | 3/2009 |
| CN | 201219871 | Y | 4/2009 |
| CN | 201365881 | Y | 12/2009 |
| CN | 101862161 | A | 10/2010 |
| CN | 202714804 | U | 2/2013 |
| CN | 104545695 | A | 4/2015 |
| CN | 204581153 | U | 8/2015 |
| CN | 105902240 | A | 8/2016 |
| CN | 107157400 | A | 9/2017 |
| DE | 3904289 | A1 | 8/1990 |

* cited by examiner

WATER-ABSORBING CYCLONE DUST CUP FOR SECONDARY DUST-AIR SEPARATION AND VACUUM CLEANER THEREOF

CROSS-REFERENCE TO RELATED APPLICATIONS

This application is a continuation of International Patent Application No. PCT/CN2018/071502 with a filing date of Jan. 5, 2018, designating the United States, now pending, and further claims priority to Chinese Patent Application No. 201711049623.8 with a filing date of Oct. 31, 2017. The content of the aforementioned applications, including any intervening amendments thereto, are incorporated herein by reference.

TECHNICAL FIELD

The disclosure relates to a secondary separation dust cup and a vacuum cleaner thereof, and particularly relates to a water-absorbing cyclone dust cup for secondary dust-air separation and a vacuum cleaner adopting the dust cup.

BACKGROUND OF THE PRESENT INVENTION

Vacuum cleaners have become essential household appliances for providing neatness and cleanliness and are gradually accepted by most users. The vacuum cleaners can be classified into two categories of dry vacuum cleaners and wet and dry vacuum cleaners according to their functions, and can be classified into two categories of dust cup type vacuum cleaners and dust bag type vacuum cleaners according to dust storage modes.

The existing dust cup type vacuum cleaner generally comprises a two-stage dust-air separation, structure. A primary dust-air separation structure is used for filtering large pollutants in the air, and a secondary dust-air separation structure is used for separating and collecting small dust particles and other sundries. The traditional secondary dust-air separation structure generally forms a secondary cyclone through the matching of a filter cover plate of a dust cup and a cyclone body provided with a plurality of cyclone ports. Such structure needs more parts and involves many complicated molds and tooling; more seals are required between the parts, which is difficult to control and easy to generate air leakage and dust leakage, thereby affecting the comprehensive performance of the whole machine.

The existing secondary dust-air separation type dust cup structure adopts an axial layout, and the purpose of dust-air separation is achieved by axially superimposing layers of conical bodies and a cyclone, so that a filter structure occupies a large space of the dust cup and occupies more dust storage space. Thus, the volume of the dust cup is small, causing that the secondary dust-air separation type dust cup structure is not suitable for small vacuum cleaners and portable vacuum cleaners, and is limited in the use range.

The secondary dust-air separation type dust cup of the above structure cannot be used for water absorption, and has no water retaining structure, causing that the secondary dust-air separation type dust cup is not suitable for the wet and dry vacuum cleaners.

SUMMARY OF PRESENT INVENTION

It should be understood that the above general description and the following detailed description of the disclosure are exemplary and illustrative and are intended to provide further interpretation for the disclosure described in the claims.

Aiming at the above problems, the disclosure proposes; a dust cup capable of achieving a secondary dust, water and gas separation structure, and a vacuum cleaner.

To achieve the above purpose, the disclosure discloses a water-absorbing cyclone dust cup for secondary dust-air separation, comprising a dust cup cover body and a dust cup main body. The dust cup main body comprises a cup body portion, a primary cyclone arranged in an opening of the dust cup main body, and a secondary cyclone comprising a secondary cyclone main body with a ventilation hole defined in a center of the secondary cyclone main body; at least one air guiding portion is arranged on a bottom end surface of the secondary cyclone main body; the air guiding portions comprise spiral air guiding plates, spiral air guiding passages formed by arranging the spiral air guiding plates around the ventilation hole, and air guiding passage baffles enclosing first ends of the spiral air guiding plates; and the spiral air guiding passages are formed by spiral longitudinal extension, along the center line direction of the ventilation hole.

Preferably, the secondary cyclone is connected with the dust cup cover body and further comprises a filter shield arranged on an outer side of the ventilation hole on the bottom end surface of the secondary cyclone main body; the filter shield is hollow and cylindrical; and a cylindrical surface of the filter shield is provided with a plurality of grill-shaped openings to form air inlet surfaces; a sum of the areas of the air guiding passage baffles and the area of opening portions of second ends of the spiral air guiding passages is larger than a sum of the areas of the air inlet surfaces.

Preferably, the dust cup main body further comprises: a first water baffle comprising a first water baffle main body which is provided with a plurality of first water retaining grilles at a first inclined angle along the direction of a central axis, wherein the first water baffle main body is connected with a secondary dust storage portion; and a second water baffle comprising a second water bailie main body which is provided with a plurality of second water retaining grilles at a second inclined angle along the direction of the central axis; and the first inclined angle is equal to the second inclined angle and is less than 45 degrees.

Preferably, the dust cup further comprises: a secondary cyclone shield in a conical shape arranged on the bottom end surface of the secondary cyclone main body, and an air inlet is defined on a conical surface of the secondary cyclone shield.

Preferably, the dust cup further comprises: a water discharge mechanism comprising a water discharge valve and a water discharge valve control switch, wherein the water discharge valve control switch is, rotated to turn on or turn off the water discharge valve to discharge accumulated water in the dust cup main body.

Preferably, the primary cyclone comprises a primary accommodating portion; the primary accommodating portion, is connected with a primary filter portion comprising a plurality of filter holes; the primary filter portion is connected with the secondary dust storage portion; and a primary dust retaining portion which extends out in a wide-mouthed shape is further arranged between the primary filter portion and the secondary dust storage portion.

The disclosure further discloses a vacuum cleaner, comprising a brush head component, a dust cup component, and any of the above water-absorbing cyclone dust cup for secondary dust-air separation; the dust cup is installed in the dust cup component, and the brush head component comprises: a ground brush base provided with a return air nozzle; a rolling brush component arranged in the ground brush base; and an impeller component communicated with the return air nozzle, forming transmission, connection with the rolling brush component and used for driving the rolling brush component to rotate.

Preferably, the impeller component comprises an impeller and an impeller shield; the impeller is connected with the rolling brush component through a transmission component; the impeller shield is sheathed on the impeller; and the impeller shield is communicated with the return air nozzle.

Preferably, the impeller shield is provided with at least one impeller shield air inlet and at least one impeller shield air outlet; the impeller shield air inlet is connected with the return air nozzle; and the impeller shield air outlet faces the rolling brush component.

Preferably, the brush head component further comprises a ground brush upper cover; the ground brush upper cover is covered on the ground brush head base; the ground brush upper cover is provided with a return air duct and a return air inlet; the return air duct is communicated with the return air inlet; and the height of the return air inlet from a horizontal plane is 1-3 mm.

The water-absorbing cyclone dust cup for secondary dust-air separation with the above structure can be applied to the vacuum cleaner to achieve the following three improvements:

Firstly, the number of parts is reduced, the assembling procedure is simplified, and the comprehensive performance of the whole machine is improved.

Secondly, the proportion of the secondary dust-air separation structure to the space of the dust cup is reduced, thereby increasing the volume of the dust cup and improving the dust collection efficiency.

Thirdly, the water-air separation is realized at the same time, so that the cyclone dust cup is also applicable to wet and dry vacuum cleaners of various sizes.

DESCRIPTION OF THE DRAWINGS

Embodiments of the disclosure will now be described in detail with reference to the drawings. Preferred embodiments of the disclosure will now be referred to in detail, and examples will be shown in the drawings. Wherever possible identical marks will be used to represent identical or similar parts throughout the drawings. In addition, although the terms used in the disclosure are selected from well-known common terms, some of the terms mentioned in the description of the disclosure may be selected by the applicant according to his or her judgment, and the detailed meanings thereof are described in the relevant part described herein. In addition, the disclosure is required to be understood not only by the actual terms used, but also by the meanings of each term.

The above and other purposes, features and advantages of the disclosure will become apparent to those of ordinary skill in the art under the teaching of the detailed description of the disclosure below by referring to the drawings.

REFERENCE NUMERALS

Figure 1:
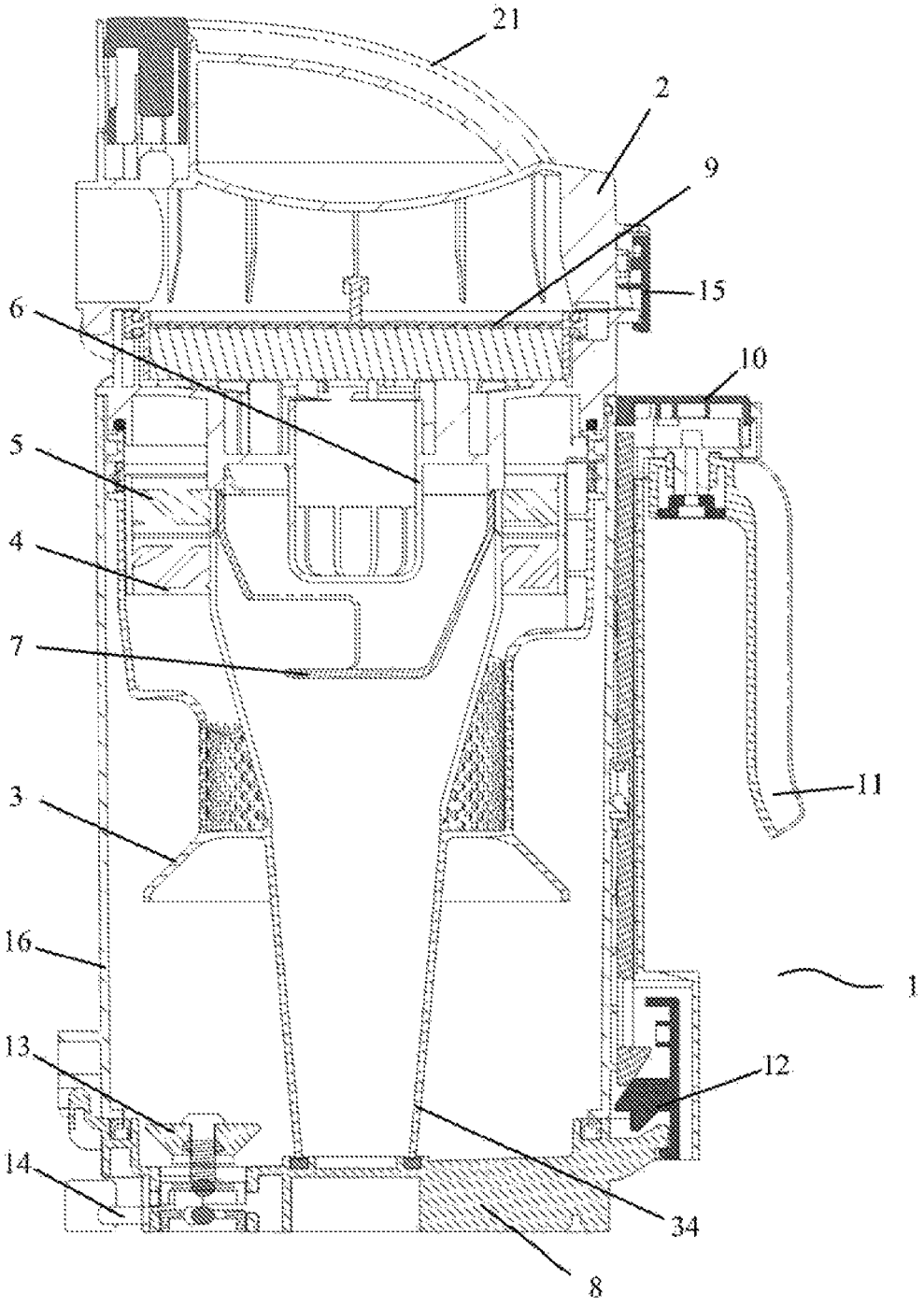
FIG. 1 is a sectional view of a water-absorbing cyclone dust cup for secondary dust-air separation according to the disclosure.

1—duct cup main body
2—duct cup cover body
21—duct cup cover handle
3—primary cyclone
4—first water baffle
5—second water baffle
6—secondary cyclone
7—secondary cyclone shield
8—bottom cover
9—filter portion
10—dust dumping button
11—dust cup handle
12—dust cup release control switch
13—water discharge valve
14—water discharge valve control switch
15—connecting buckle
31—primary accommodating portion
32—primary filter portion
33—primary dust retaining portion
34—secondary dust storage portion
35—connecting convex portion
41—first water baffle main body
42—first water retaining grille
43—secondary dust storage portion
44—connecting concave portion
51—second water baffle main body
52—second water retaining grille
53—connecting concave portion
60—secondary cyclone main body
61—filter shield

62—first air guiding portion
63—second air guiding portion
64—ventilation hole
67—connecting lug portion
68—supporting portion
211—ground brush base
231—return air nozzle
241—impeller
251—impeller shield
2511—impeller shield air inlet
261—transmission component
271—impeller shield air outlet
281—air inlet pipe
2811—air inlet
291—air inlet nozzle
221—rolling brush component
301—ground brush upper cover
311—return air duct
401—brush head vacuum chamber
501—first groove
502—second groove
601—air inlet surface
621—first spiral air guiding plate
622—first spiral air guiding passage
623—first air guiding passage baffle
624—first opening portion
625—reinforcing rib
631—second spiral air guiding plate
632—second spiral air guiding passage
633—second air guiding passage baffle
634—second opening portion
100—dust cup component
200—motor shield component
300—hose component
400—ground brush component
500—large-body component
600—handle component

DETAILED DESCRIPTION OF PREFERRED EMBODIMENTS

The disclosure discloses one or more embodiments combined with the features of the disclosure. The disclosed embodiments only illustrate the disclosure. The scope of the disclosure is not limited to the disclosed embodiments. The disclosure is defined by the appended claims.

The phrases "one embodiment", "an embodiment", "an exemplary embodiment" and the like used in the description indicate that the described embodiments may include a special feature, structure or characteristic, however it is not necessary for all the embodiments to include the special feature, structure or characteristic. In addition, these phrases do not necessarily relate to the same embodiments. In addition, if the special feature, structure or characteristic is described in combination with one embodiment, it is within the knowledge of one of ordinary skill in the art to realize the special feature, structure or characteristic in combination with other embodiments (whether or not explicitly described).

In addition, it shall be understood that the spatial descriptions, used herein (e.g., on, under, above, left, right, below, top, bottom, vertical, horizontal, etc.) are for the illustrative purpose only, and the actual implementation of the structures described herein can be spatially arranged in any orientation or manner.

The disclosure is further described below, in detail with reference to the drawings and the embodiments.

The entire sectional view of a water-absorbing cyclone dust cup for secondary dust-air separation disclosed by the disclosure is shown in FIG. 1.

The water-absorbing cyclone dust cup comprises a dust cup cover body 2 with a dust cup cover handle 21, and a dust cup main body 1 below the dust cup cover body 2. The dust cup cover body 2 and the dust cup main body 1 are movably connected by a connecting buckle 15.

The dust cup main body 1 comprises a hollow and cylindrical cup body portion 16. A primary cyclone 3, a first water baffle 4, a second water baffle 5 and a secondary cyclone 6 are arranged at an opening of the cup body, portion 16. A filter portion 9 is arranged on atop surface of the secondary cyclone 6. The secondary cyclone 6 is positioned on the topmost part of the cup body portion 16.

Figure 2:
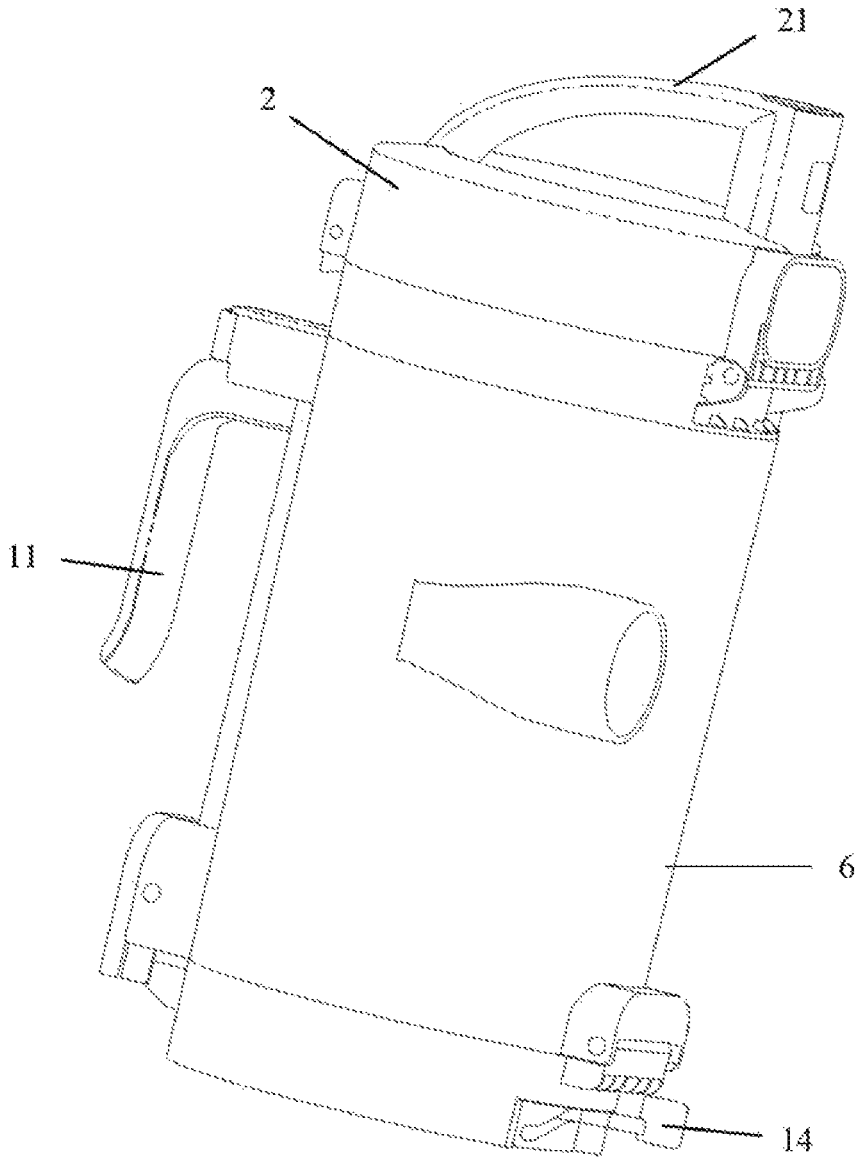
FIG. 2 is an appearance diagram of FIG. 1.
Figure 3:
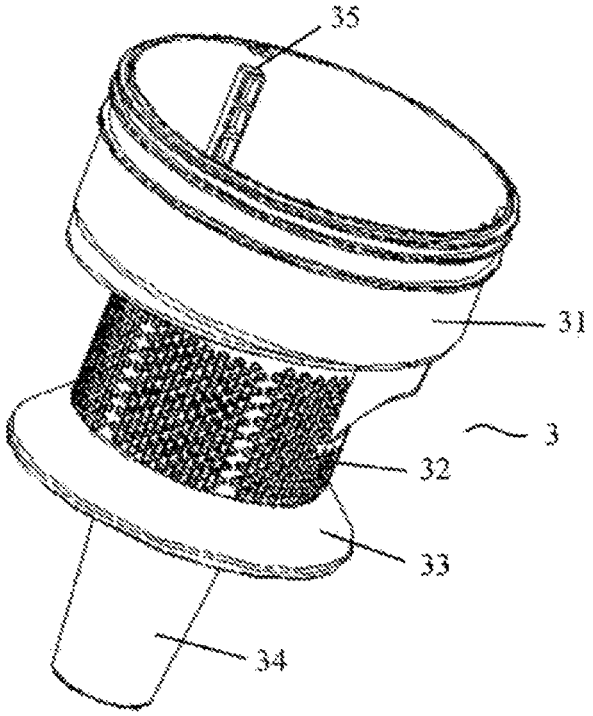
FIG. 3 is a structural schematic diagram of a primary cyclone according to the disclosure.

The structure of the primary cyclone 3 is shown in FIG. 2 and FIG. 3. The structure is used as a primary filtration component in the cyclone dust cup for secondary dust-air separation in, the disclosure, and firstly plays a role of preventing large particles of dust from entering into the process of dust-air separation. The following is the specific illustration:

The primary cyclone 3 comprises a primary accommodating portion 31 positioned at the upper end, a primary filter portion 32 comprising a plurality of filter holes and connected with the lower end of the primary accommodating portion 31, a secondary dust storage portion 34 connected with the lower end of the primary filter portion 32, and a primary dust retaining portion 33 which extends out in a wide-mouthed shape between the primary filter portion 32 and the secondary dust storage portion 34.

Figure 4:
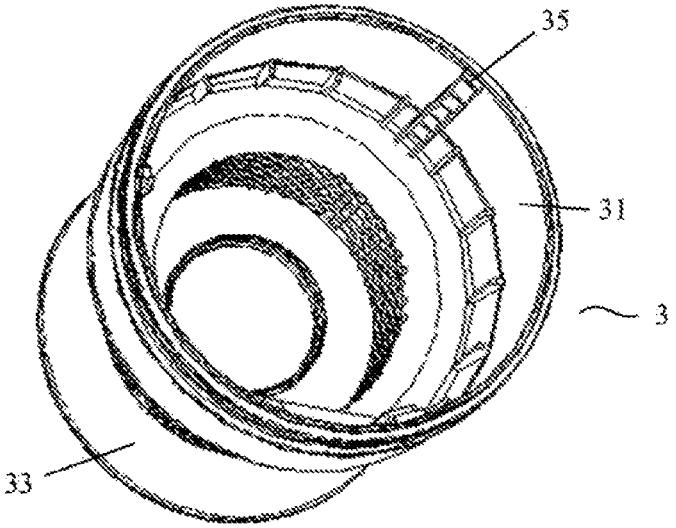
FIG. 4 is a top view of FIG. 3.
Figure 5:
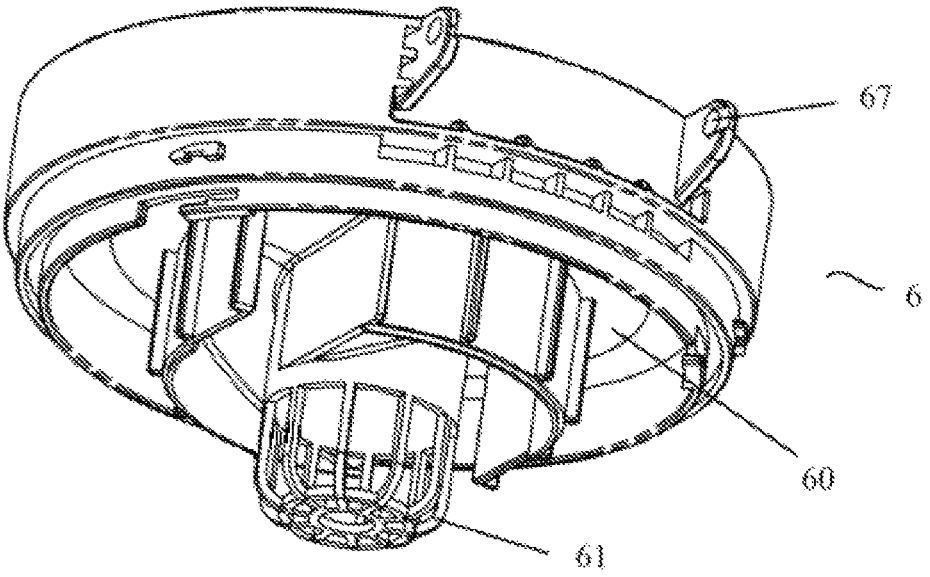
FIG. 5 is a structural schematic diagram of a secondary cyclone according to the disclosure.
Figure 6:
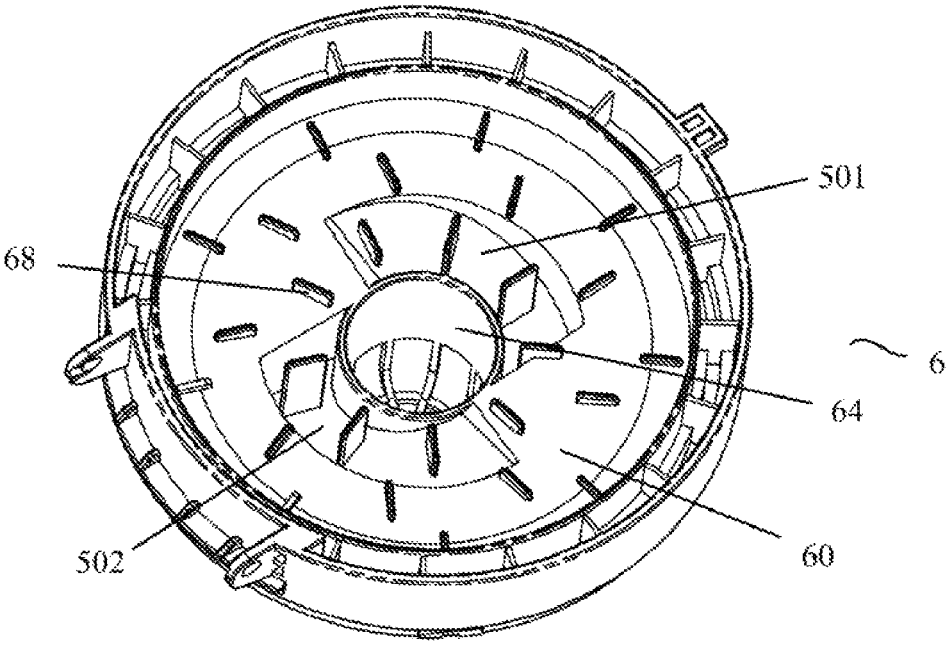
FIG. 6 is atop view of FIG. 5.

FIG. 4 is a three-dimensional structure of the secondary cyclone 6 according to the disclosure. FIG. 5 is a structural schematic diagram showing atop of the secondary cyclone 6. FIG. 6 is a structural schematic diagram showing a bottom of the secondary cyclone 6.

Referring to above three figures, the secondary cyclone 6 comprises a secondary cyclone main body 60 which is in the shape of a cover body with a certain thickness. The top end surface and the bottom end surface of the main body 60 have different structures which are respectively shown in FIG. 5 and FIG. 6.

Referring to FIG. 5, a ventilation hole 64 is formed in a center of the secondary cyclone main body 60. The bottom end surface of the ventilation hole 64 is connected with a filter shield 61. The filter shield 61 is of a hollow and cylindrical structure. A cylindrical surface of the filter shield 61 is provided with a plurality of grill-shaped openings to form a plurality of air inlet surfaces 601. The top end surface of the filter shield 61 is provided with a plurality of bulges in the circumferential direction around the ventilation hole 64 to form a supporting portion 68 for supporting the filter portion 9 thereon.

Further referring to FIG. 6, FIG. 6 shows the structure of the bottom end surface of the secondary cyclone 6.

The filter shield 61 is protruded around the bottom end surface, and a first air guiding portion 62 and a second air guiding portion 63 are arranged along the circumferential direction. The first air guiding portion 62 and the second air guiding portion 63 are respectively formed by a combination of a spiral air guiding plate, a spiral air guiding passage and an air guiding passage baffle. Specifically, a first spiral air guiding plate 621 and a second spiral air guiding plate 631 form certain angles with the bottom end surface, generally 90 degrees, and are arranged spirally by using the filter shield 61 as a circle center. A first spiral air guiding passage 622 and a second spiral air guiding passage 632 are respectively formed between the first spiral air guiding plate 621 and the filter shield 61 and between the second spiral air guiding plate 631 and the filter shield 61.

Figure 7:
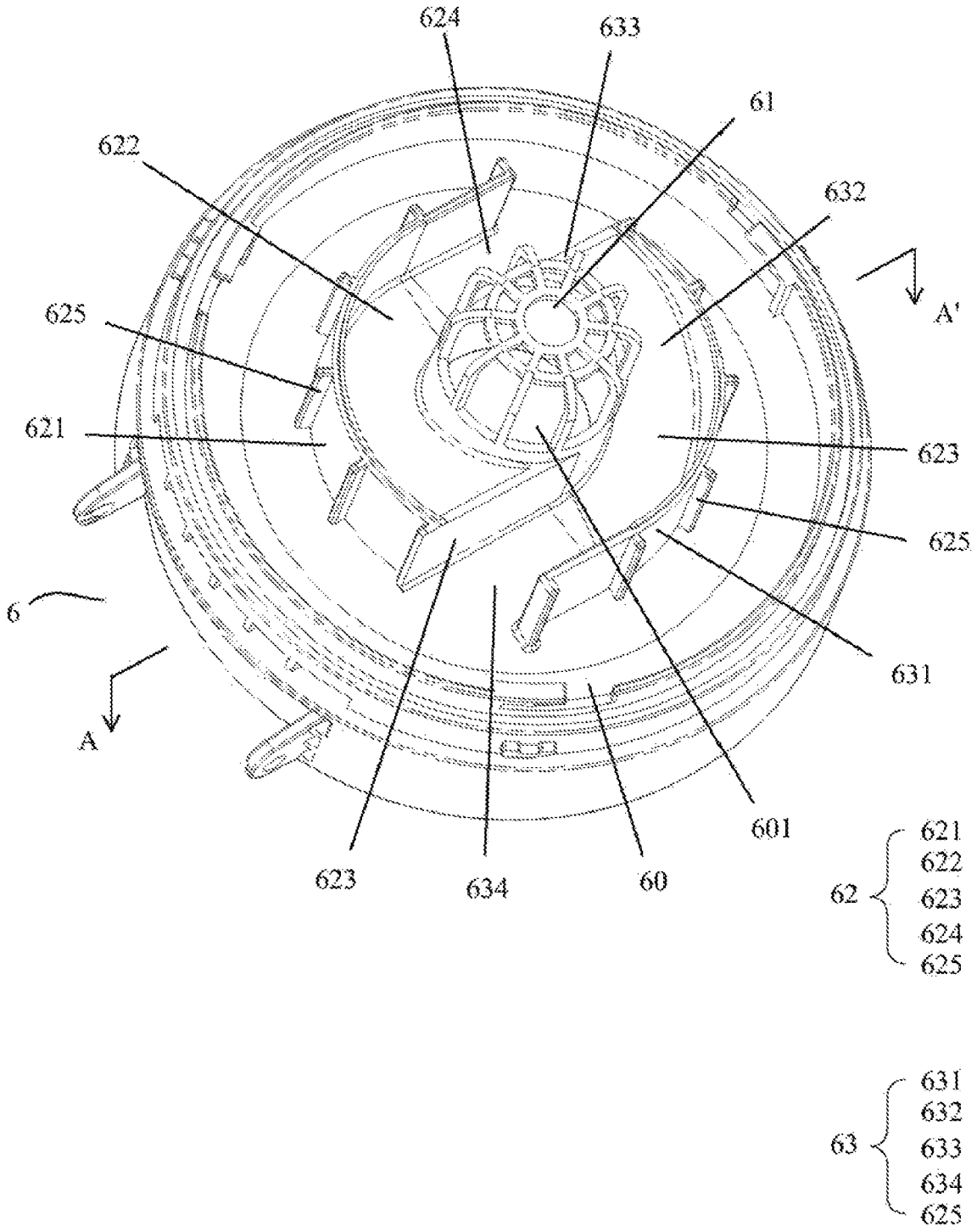
FIG. 7 is a bottom view of FIG. 5.

By taking the second spiral air guiding passage 632 as an example, the sectional view of FIG. 7 further illustrates a specific structure of the second spiral air guiding passage 632. The second spiral air guiding passage 632 is formed by spiral longitudinal extension along the center line direction of the ventilation hole 64, and has a curved slide shape shown in FIG. 7. Thus, the shape of a second groove 502 is formed on the top end surface of the secondary cyclone main body 60 shown in FIG. 5. Similarly, the first spiral air guiding passage 622 is of a similar structure, and a first groove 501 is formed on the top end surface of the secondary cyclone main body 60.

Further, in addition to the above air guiding plates and the air guiding passages, two air guiding portions 62 and 63 respectively comprise a first air guiding passage baffle 623 and a second air guiding passage baffle 633 which arc respectively connected with the first ends of the first spiral air guiding plate 621 and the second spiral air guiding plate 631 and the edge of the filter shield. Thus, the first spiral air guiding passage 622 and the second spiral air guiding passage 632 respectively form a first opening portion 624 and a second opening portion 634, and the other end is a closed structure. The opening of the first spiral air guiding passage 622 and the air guiding passage, baffle of the second spiral air guiding passage 632 are adjacently arranged.

According to the air guiding requirement of the dust cup of the disclosure for the secondary dust-air separation, the design requirement for the first air guiding portion 62 is that a sum of the area S1 of the first air guiding passage baffle 623 and the area S2 of the first opening portion 624 is larger than, a sum S3 of the area of the air inlet surfaces 601 of the filter shield 61.

Similarly, the requirement for the second air guiding portion 63 is also that a sum of the area S1 of the second air guiding passage baffle 633 and the area S2 of the second opening portion 634 is larger than a sum S3 of the area, of the air inlet surfaces 601 of the filter shield 61.

In addition, the outer side surfaces of the spiral air guiding plates 621 and 631 are also uniformly provided with a plurality of reinforcing ribs 625 for reinforcing the strength of side walls of an air duct.

FIG. 4 further shows that, a connecting lug portion 67 is arranged on the side edge of a side cover body of the secondary cyclone main body 60 for connection with the dust cup cover body 2.

Figure 8:
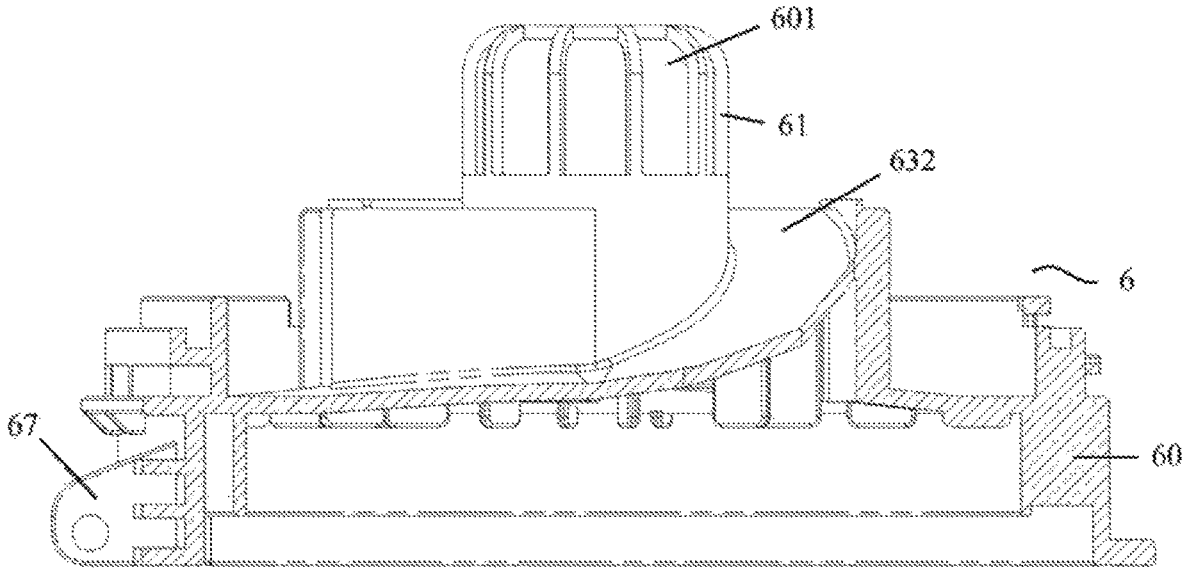
FIG. 8 is a sectional view along line A-A' of FIG. 7.

FIG. 8 shows a schematic diagram of a combination of the secondary cyclone main body 60 of the above structure and a secondary cyclone shield 7. The cyclone shield forms a conical shape and small particles of dust may be thrown through the openings 71 on the cyclone shield. On two spiral air guiding plates, air inlets 71 are formed on the conical surfaces.

Figure 9:
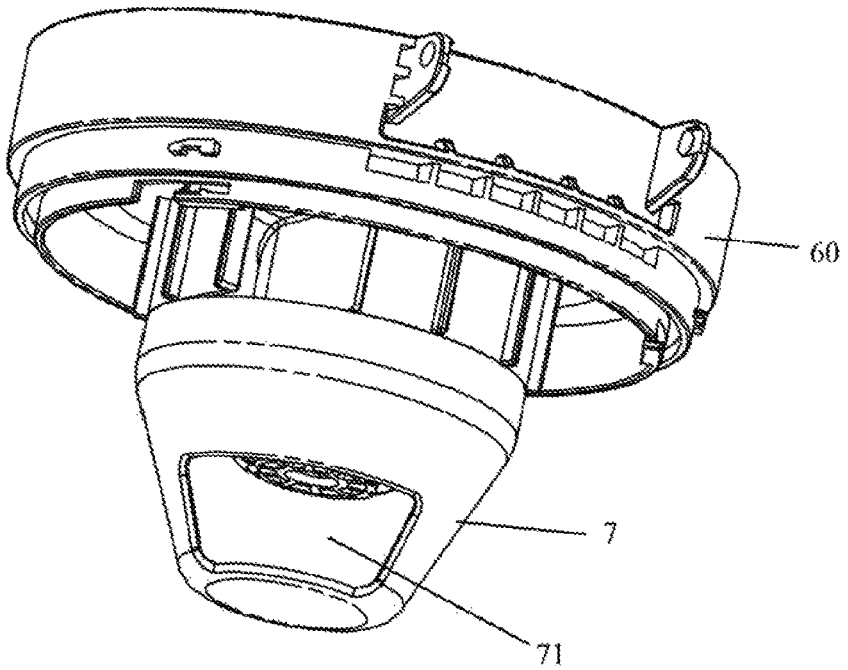
FIG. 9 is a schematic diagram showing a combination of a secondary cyclone and a secondary cyclone shield according to the disclosure.
Figure 10:
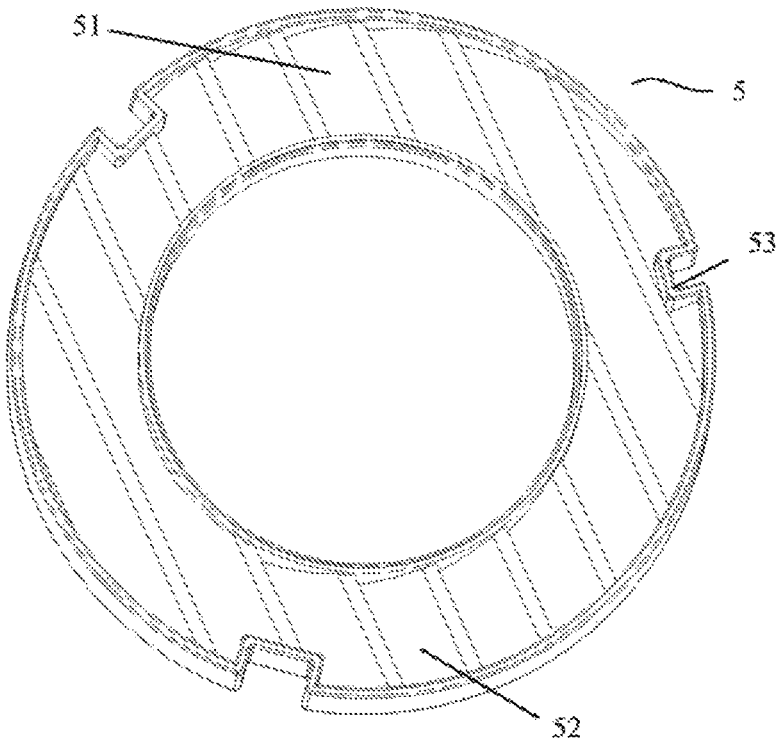
FIG. 10 is a structural schematic diagram of a second water baffle.

FIG. 9 and FIG. 10 respectively show the structural schematic diagrams of a second water baffle 5 and a first water baffle 4.

As shown in FIG. 9, the second water baffle 5 comprises a second water baffle main body 51 in a ring shape; and a plurality of second water retaining grilles 52 at a certain inclined angle are arranged on the second water baffle main body 51 along the direction of a central axis.

FIG. 10 shows the first water baffle 4 arranged below the second water baffle 5. The first water baffle 4 comprises a first water baffle main body 41 in a ring shape. The first water baffle main body 41 of the same structure is provided with a plurality of first water retaining grilles 42 at a certain inclined angle along the direction of a central axis; the bottom end of the first water baffle 4 is connected with a secondary dust storage portion 43; and the secondary dust storage portion 43 is in the shape of a hollow circular truncated cone.

The inclined angles of the water retaining grilles 42 and 52 on the above two water baffles 4 and 5 are identical, and are less than 45 degrees. When the two water baffles are assembled, the positions of the two water baffles are arranged in accordance with the inclined angles of opposite directions.

Figure 11:
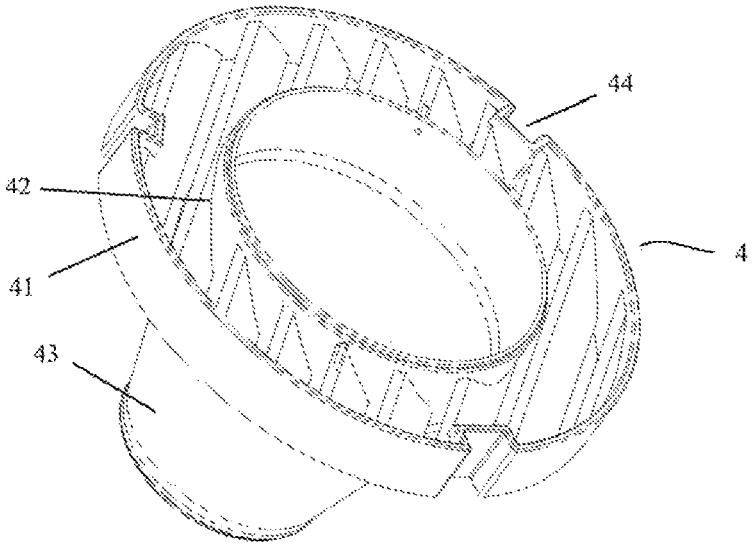
FIG. 11 is a structural schematic diagram of a first water baffle.
Figure 12:
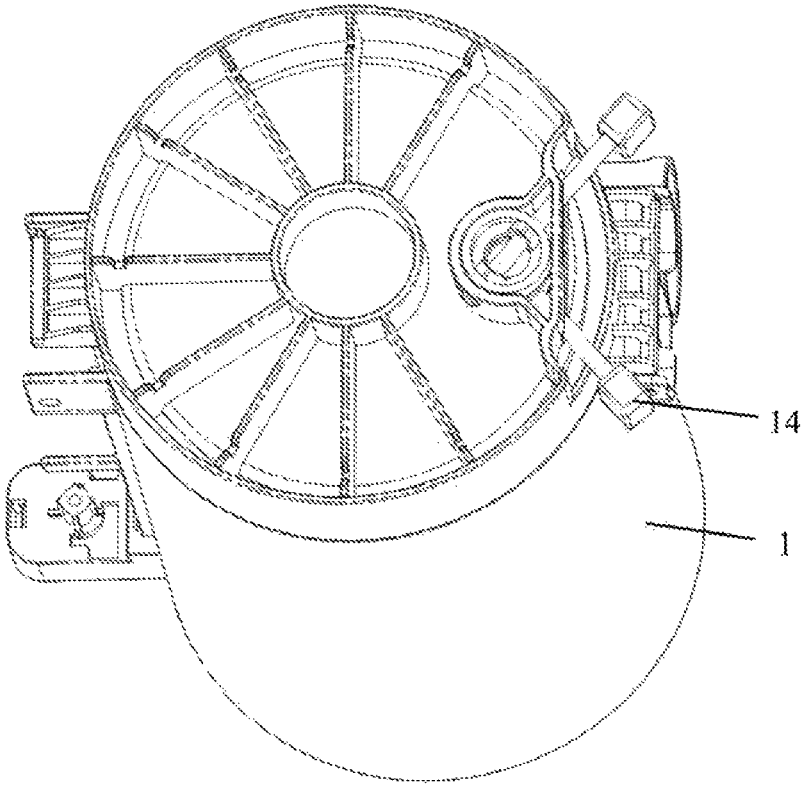
FIG. 12 is a structural schematic diagram showing a waterproof portion of a cyclone dust cup according to the disclosure.
Figure 13:
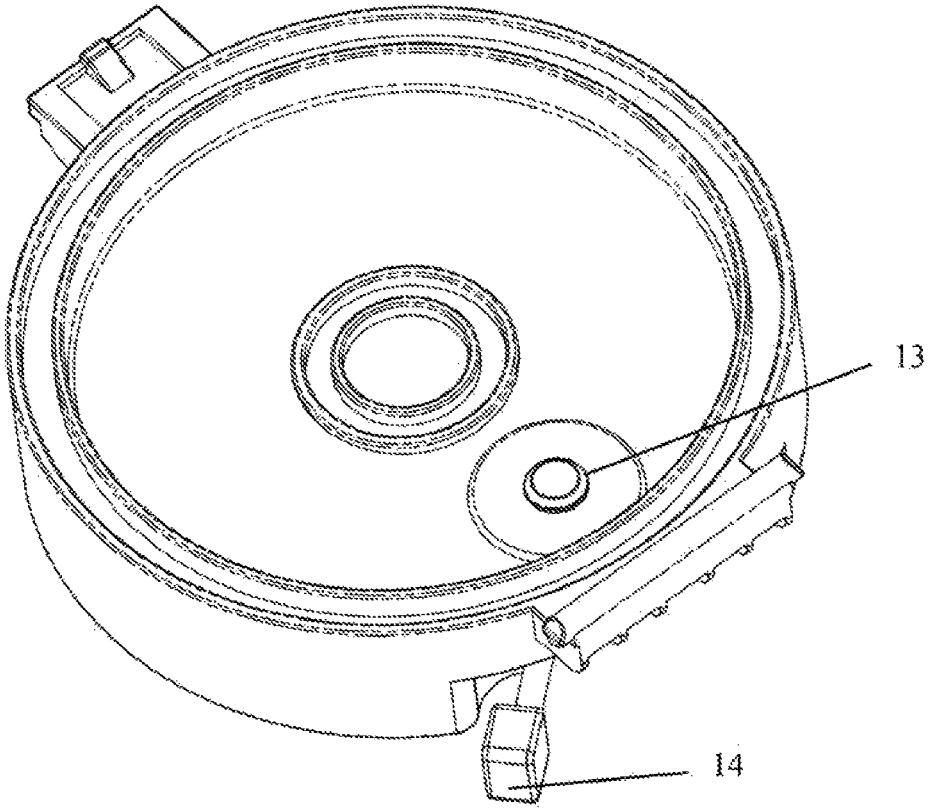
FIG. 13 is a structural schematic diagram showing a bottom portion of a cyclone dust cup according to the disclosure.
Figure 14:
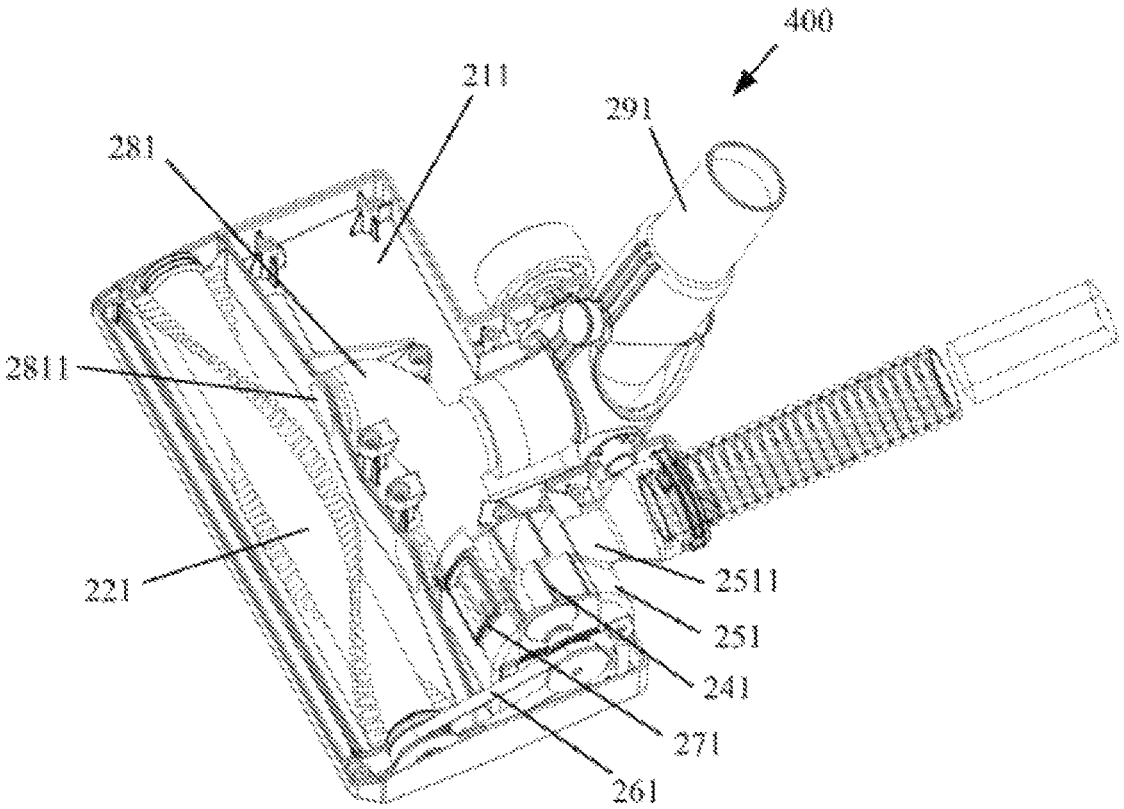
FIG. 14 is a structural schematic diagram showing an interior of a brush head of a vacuum cleaner according to the disclosure.
Figure 15:
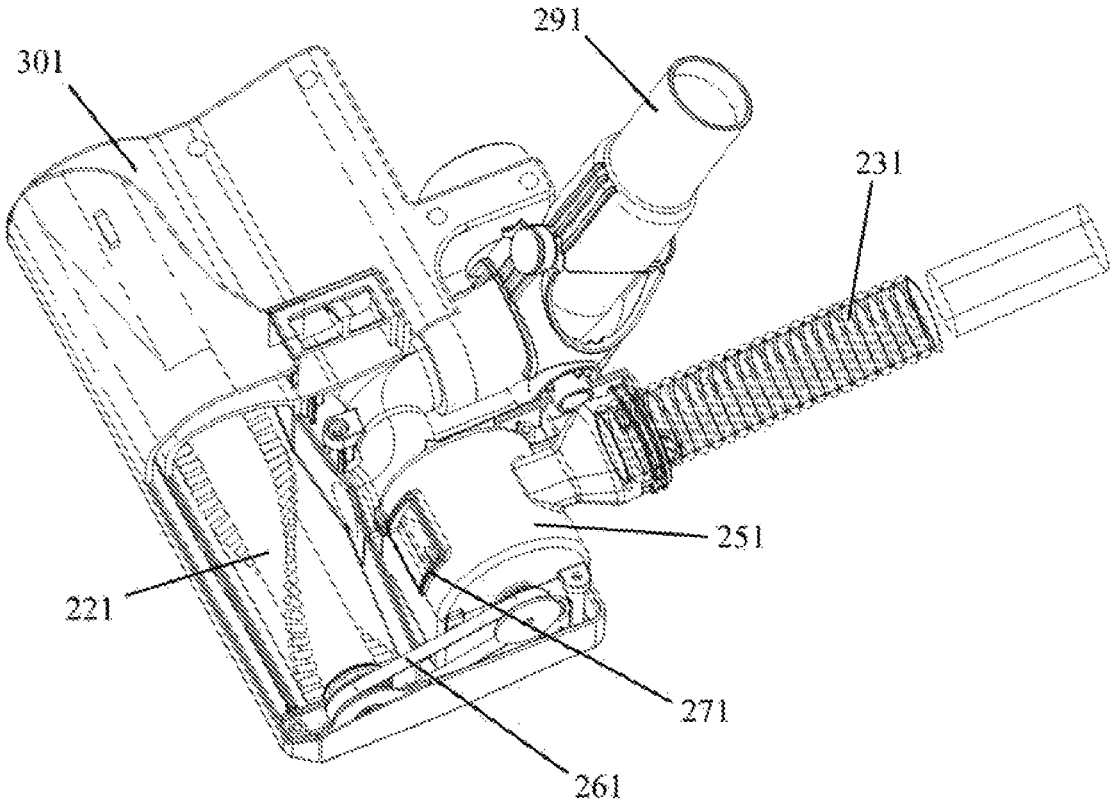
FIG. 15 is a structural schematic diagram of a brush head of a vacuum cleaner according to the disclosure, wherein an impeller shield is locally sectioned.
Figure 16:
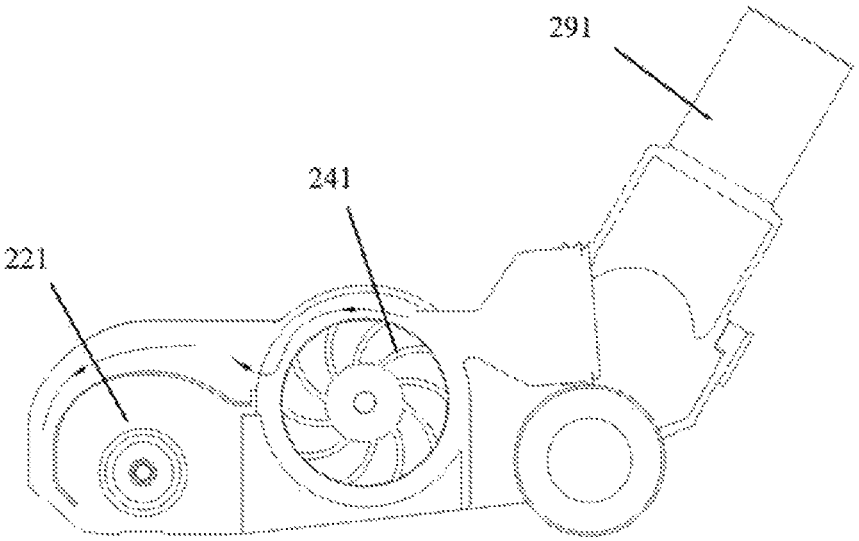
FIG. 16 is a first schematic diagram showing an impeller and an air duct in a brush head of a vacuum cleaner according to the disclosure.
Figure 17:
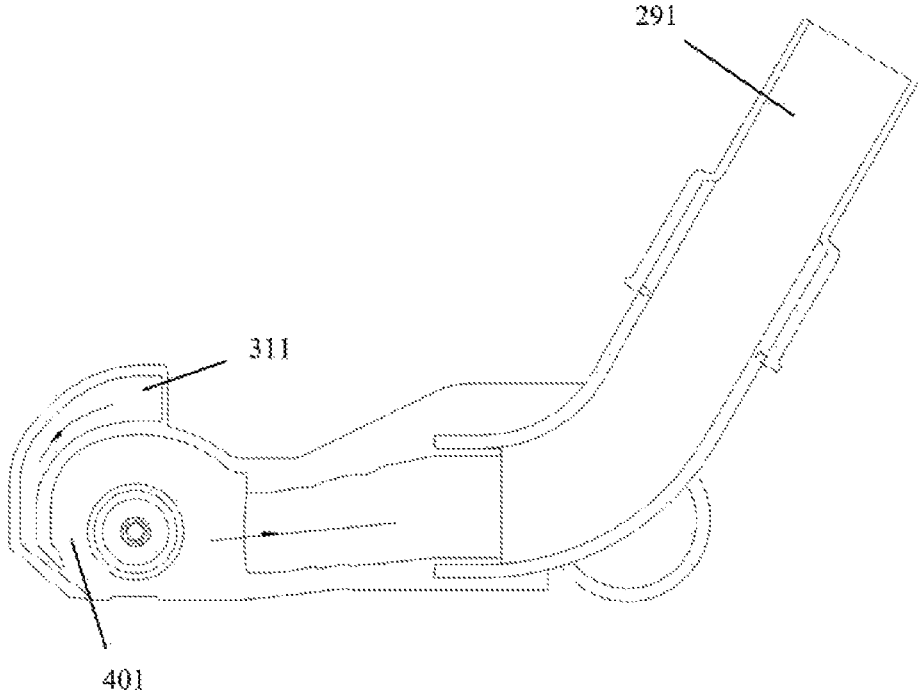
FIG. 17 is a second schematic diagram showing an impeller and an air duct in a brush head of a vacuum cleaner according to the disclosure.

Further referring to FIG. 1, in order to cooperate with the water absorption function added in the disclosure, at the bottom of the dust cup main body 1, a water discharge mechanism is arranged and comprises a water discharge valve 13 and a water discharge valve control switch 14. The control switch 14 provided in a preferred embodiment shown in FIG. 11 adopts a shifter level structure, and the direction of the shifter level is horizontally rotated to play a role of turning on the water discharge valve 13 connected with the other end of the control switch, so as to discharge accumulated water in the dust cup main body 1.

In combination with FIG. 1, the assembling and working process of the cyclone dust cup for secondary dust-air separation according to the disclosure is described.

The primary cyclone 3 is firstly put into the opening of the hollow and cylindrical dust cup main body 1. The opening of the primary accommodating portion 31 is upward. Then, the first water baffle 4 is put into the opening. The side surface of the first water baffle main body 41 is provided, with a plurality of connecting concave portions 44 which are embedded with connecting convex portions 35 at the inner side of the primary accommodating portion 31 of the primary cyclone 3, so as to play a role of clamping and fixation.

Then, the second water baffle 5 is put into the opening. Similarly, the side edge of the second water baffle main body 51 is also provided with connecting concave portions 53 which are embedded with the connecting convex portions 35 at the inner side of the primary accommodating portion 31 of the primary cyclone 3, so as to play a role of clamping and fixation.

To completely block the water from entering the secondary cyclone, when, the first water baffle 4 and the second water baffle 5 are assembled, the first water baffle 4 and the second water baffle 5 are placed in opposite directions of the inclined angles.

The secondary cyclone 6 is connected with the dust cup cover body 2 through the connecting lug portion 67, and the secondary cyclone shield 7 connected to the bottom end of the secondary cyclone 6 shown in FIG. 8 falls into the openings in the centers of the two water baffles 4 and 5.

In addition, a filter portion 9, which is generally a sponge made of polyester material, is further arranged on the top surface of the secondary cyclone 6.

To cooperate with the use of the above dust cup, other auxiliary members such as a dust dumping button 10 of the dust cup, a dust cup handle 11 and a dust cup release control switch 12 are also illustrated in FIG. 1.

The working process of the disclosure is described below in combination with the above structure.

When the dust-air mixture passes through the air inlet (not shown) of the side wall of the dust cup main body 1 and enters the primary filter 3 through the primary filter portion 32 of a plurality of filter holes, large particles of dust are separated into the dust storage space between the dust cup main body 1 and the bottom cover 8.

Next, the dust-air mixture enters the interior of the primary cyclone 3, and enters the cyclone from the bottom end surface of the secondary cyclone 6 through the first water baffle 4 and the second water baffle 5. When water exists in the dust-air mixture, due to the unique design of the water retaining, grilles, the water is blocked by the first and the second water baffles 4 and 5, retained in the space formed by the first cyclone 3 and the two water baffles, and then flows into the dust storage space (which is the same as the space of the above large particles of dust) between the dust cup main body 1 and the primary cyclone 3 through the filter hole of the primary filter portion 32 of the primary cyclone 3. Thus, the water cannot enter the secondary cyclone 6.

For the dust-air mixture of the secondary cyclone 6, the small particles of dust are separated into a secondary dust storage chamber. The separated air is then filtered through a dust cup filter element 9 arranged at the top of the secondary cyclone 6 and enters the space of the dust cup cover body 2, and clean air enters a motor from the air outlet, of the dust cup cover body 2.

The water discharge valve 13 and the water discharge valve control switch 14 located at the bottom of the dust cup main body 1 are used to release the sewage in the dust storage space, of the dust cup.

As shown in FIG. 14 to FIG. 17, the disclosure also discloses a ground brush component 400 on a vacuum cleaner. The ground brush component 400 comprises a ground brush base 211, a rolling brush, component 221 and an impeller component. The ground brush base 211 is provided with a return air nozzle 231; and the rolling brush component 221 is arranged in the ground brush base 211. The impeller component is communicated with the return air nozzle 231, and the impeller component is in transmission connection with the rolling brush component 221, so as to drive the rolling brush component 221 to rotate.

Preferably, the impeller component herein comprises an impeller 241 and an impeller shield 251; and the impeller 241 is connected with the rolling brush component 221 through a transmission component 261. The impeller shield 251 is sheathed on the impeller 241; and the impeller shield 251 is communicated with the return air nozzle 231. Further, the impeller shield 251 is provided with at least one impeller shield air inlet 2511 and at least one impeller shield air outlet 271; the impeller shield air inlet 2511 is connected with the return air nozzle 231; and the impeller shield air outlet 271 faces the rolling brush component 221. Herein, the impeller shield air inlet 2511 may be preferably a square, and the sectional area of the impeller shield air inlet 2511 is 100 $mm^2$ to 300 $mm^2$.

In addition, the ground brush component 400 further comprises an air inlet pipe 281. The air inlet pipe 281 is arranged in the ground brush base 211. Meanwhile, the ground brush base 211 is also provided with an air inlet nozzle 291. The air inlet pipe 281 is communicated with the air inlet nozzle 291. Preferably, the air inlet pipe 281 is, also provided with a plurality of air inlets 2811. For example, the air inlets 2811 face the rolling brush component 221 to ensure that the suction force of a ground brush vacuum chamber relative to the ground is uniform.

Further, the transmission component 261 herein comprises a transmission belt and two transmission wheels. The two transmission wheels are respectively installed on the end part of the impeller 241 and the end part of the rolling brush component 221. The transmission belt is connected with the two transmission wheels. Both ends of an impeller shaft of the impeller 241 are fixed and rotated through ball bearings, to greatly reduce rotation resistance of the impeller and increase rotation speed. The impeller 241 is blown through return air, so as to drive the rolling brush component 221 to rotate.

Further, the ground brush component 400 further comprises a ground brush upper cover 301; the ground brush upper cover 301 is covered on a brush head base 211; the ground brush upper cover 301 is provided with a return air duct 311 and a return air inlet 321 so that the return air duct 311 is communicated with the return air inlet 321; and the height of the return air inlet 321 from a horizontal plane is 1-3 mm. The return air duct 311 is connected with the impeller component and the brush head base 211 to collect and guide the return air that passes through the impeller component into the ground brush vacuum chamber, so as to achieve the purpose of reducing moving resistance.

According to the above structure, the ground brush component 400 guides the return air into the impeller component through the return air nozzle 231, and transmits the return air to the rolling brush component 221 through the transmission component 261. The return air that passes through the impeller component is collected by the return air duct 311 and guided into the brush head base 211, then enters the brush head vacuum chamber 401, and is sucked into the vacuum cleaner through the air inlet pipe 281.

Figure 18:
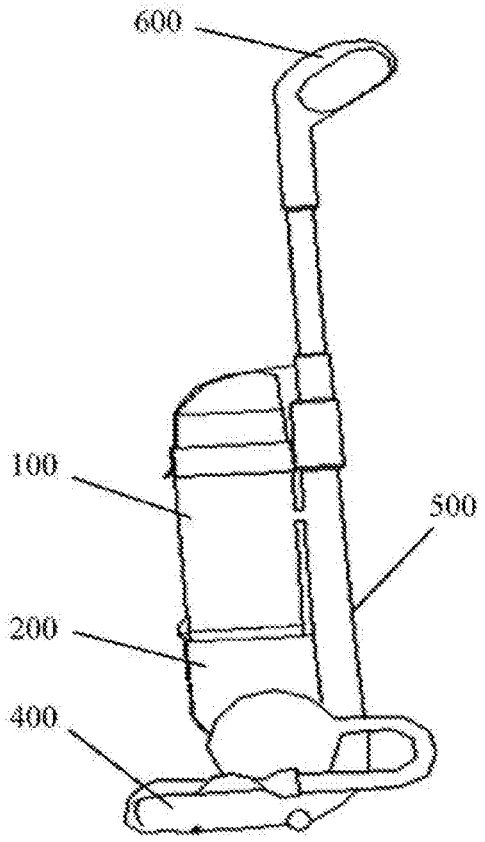
FIG. 18 is a structural schematic diagram of a vertical vacuum cleaner according to the disclosure.
Figure 19:
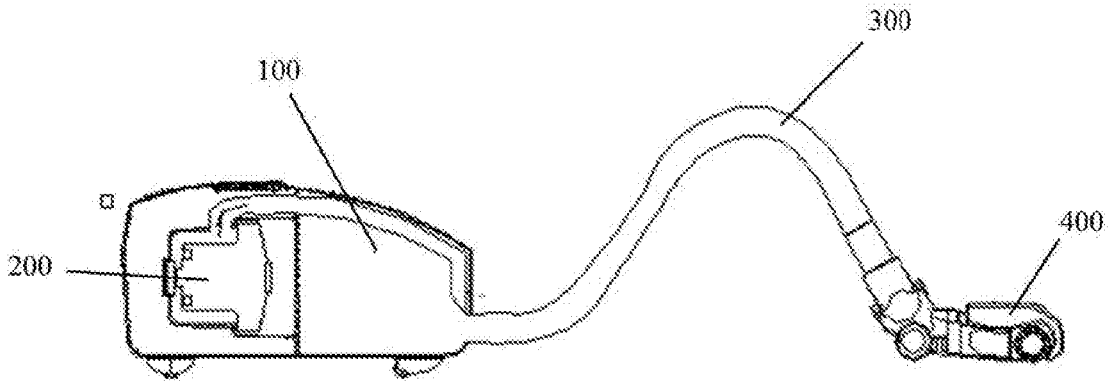
FIG. 19 is a structural schematic diagram of a horizontal vacuum cleaner according to the disclosure.

The water-absorbing cyclone dust cup for secondary dust-air separation of the above structure and the ground brush component can be applied to FIG. 18 and FIG. 19. The dust cup is applied to the dust cup component 100. A vertical vacuum cleaner illustrated in FIG. 18 further comprises a large-body component 500 and a handle component 600, and the dust cup component 100 is connected with a motor shield component 200.

FIG. 19 shows a horizontal vacuum cleaner that applies the above dust cup and the ground brush structure. A hose component 300 between the ground brush component 400 and the dust cup component 100 is used for connecting the ground brush component 400 and the dust cup component 100, and the dust cup component 100 is connected with the motor shield component 200. The vacuum cleaner using the dust cup component and the ground brush component of the above structure of the disclosure has the following advantages:

Firstly, novel water baffle structures are added to effectively prevent the water from entering the filter element and entering the motor, and are suitable for a wet and dry vacuum cleaner.

Secondly, while the purpose of secondary dust-air separation is achieved, the number of parts and the assembly, procedures are greatly reduced, the dust storage volume of the dust cup is increased, and the comprehensive performance of the whole machine is more stable.

Thirdly, the simplification of the secondary dust-air separation structure greatly reduces the size of the dust cup, and thus the structure is suitable for vacuum cleaners of various sizes.

Fourthly, the vacuum cleaner brush head of the disclosure and the vacuum cleaner comprising the same use the return air of the main motor as the power for the impeller to rotate, with the power being strong, are suitable for use on a carpet, and has no problem that the impeller is blocked or clamped by dust or particles. By replacing a rolling brush motor with the return air of the main motor as the rolling brush power, the cost and energy consumption are greatly reduced.

The above disclosure provides the description of preferred embodiments to enable one of ordinary skill in the art to use or apply the disclosure. Various modifications to these embodiments are apparent to those of ordinary skill in the and the general principles described herein may be applied to other embodiments without creative work. Thus, the disclosure is not limited, to the embodiments shown herein, but shall be in accordance with the widest scope of the principles and new features disclosed herein.

We claim:

1. A water-absorbing cyclone dust cup for secondary dust-air separation, comprising a dust cup cover body and a dust cup main body, wherein the dust cup main body comprises:

a cup body portion;

a primary cyclone arranged in an opening of the dust cup main body;

a secondary cyclone comprising a secondary cyclone main body with a ventilation hole defined in a center of the secondary cyclone main body, wherein at least one air guiding portion is arranged on a bottom end surface of the secondary cyclone main body; the air guiding portion comprises spiral air guiding plates, spiral air guiding passages formed by arranging the spiral air guiding plates around the ventilation hole, and air guiding passage baffles enclosing first ends of the spiral air guiding plates;

a first water baffle comprising a first water baffle main body which is provided with a plurality of first water retaining grilles at a first inclined angle along a direction of a central axis, wherein the first water baffle main body is connected with a secondary dust storage portion; and a second water baffle comprising a second water baffle main body which is provided with a plurality of second water retaining grilles at a second inclined angle along the direction of the central axis;

wherein the spiral air guiding passages are formed by spiral longitudinal extension along a center line direction of the ventilation hole; and the first inclined angle is equal to the second inclined angle and is less than 45 degrees.

2. The dust cup according to claim 1, wherein the secondary cyclone is connected with the dust cup cover body and further comprises a filter shield arranged on an outer side of the ventilation hole on the bottom end surface of the secondary cyclone main body; the filter shield is hollow and cylindrical; and a cylindrical surface of the filter shield is provided with a plurality of grill-shaped openings to form air inlet surfaces;

a sum of areas of the air guiding passage baffles and areas of opening portions of second ends of the spiral air guiding passages is larger than a sum of areas of the air inlet surfaces.

3. The dust cup according to claim 1, further comprising:

a secondary cyclone shield in a conical shape arranged on the bottom end surface of the secondary cyclone main body, wherein an air inlet is defined on a conical surface of the secondary cyclone shield.

4. The dust cup according to claim 3, further comprising:

a water discharge mechanism comprising a water discharge valve and a water discharge valve control switch, wherein the water discharge valve control switch is rotated to turn on or turn off the water discharge valve to discharge accumulated water in the dust cup main body.

5. The dust cup according to claim 4, wherein the primary cyclone comprises a primary accommodating portion; the primary accommodating portion is connected with a primary filter portion comprising a plurality of filter holes; the primary filter portion is connected with the secondary dust storage portion; and a primary dust retaining portion which extends out in a wide-mouthed shape is further arranged between the primary filter portion and the secondary dust storage portion.

6. A vacuum cleaner, comprising a brush head component, a dust cup component, and the water-absorbing cyclone dust cup for secondary dust-air separation according to claim 1, wherein the dust cup is installed in the dust cup component, and the brush head component comprises:

a ground brush base provided with a return air nozzle;

a rolling brush component arranged in the ground brush base; and an impeller component communicated with the return air nozzle, forming transmission connection with the rolling brush component and used for driving the rolling brush component to rotate.

7. The vacuum cleaner according to claim 6, wherein the impeller component comprises an impeller and an impeller shield; the impeller is connected with the rolling brush component through a transmission component; the impeller shield is sheathed on the impeller; and the impeller shield is communicated with the return air nozzle.

8. The vacuum cleaner according to claim 7, wherein the impeller shield is provided with at least one impeller shield air inlet and at least one impeller shield air outlet: the impeller shield air inlet is connected with the return air nozzle; and the impeller shield air outlet faces the rolling brush component.

9. The vacuum cleaner according to claim 8, wherein the brush head component further comprises a ground brush upper cover; the ground brush upper cover is covered on the ground brush head base; the ground, brush upper cover is provided with a return air duct and a return air inlet; the return air duct is communicated with the return air inlet; and a height of the return air inlet from a horizontal plane is 1-3 mm.

* * * * *